US007570229B2

(12) United States Patent
Lee et al.

(10) Patent No.: US 7,570,229 B2
(45) Date of Patent: Aug. 4, 2009

(54) PLASMA DISPLAY PANEL AND DRIVING METHOD THEREOF

(75) Inventors: Jun-Young Lee, Suwon-si (KR); Nam-Sung Jung, Suwon-si (KR); Kazuhiro Ito, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 466 days.

(21) Appl. No.: 11/104,729

(22) Filed: Apr. 13, 2005

(65) Prior Publication Data

US 2005/0259057 A1 Nov. 24, 2005

(30) Foreign Application Priority Data

Apr. 16, 2004 (KR) ..... 10-2004-0026174
May 28, 2004 (KR) ..... 10-2004-0038275

(51) Int. Cl.
*G09G 3/28* (2006.01)

(52) U.S. Cl. ..... 345/60; 345/63; 345/68; 315/169.4

(58) Field of Classification Search ..... 345/30, 345/33, 37, 41–42, 55, 60, 68–69, 71, 204–205, 345/208; 315/169.1–169.4
See application file for complete search history.

(56) References Cited

U.S. PATENT DOCUMENTS 5,745,086 A 4/1998 Weber
6,483,487 B2 * 11/2002 Iseki ..... 345/60
6,492,776 B2 * 12/2002 Rutherford ..... 315/169.1
6,528,952 B2 * 3/2003 Kato et al. ..... 315/169.4
6,538,392 B2 3/2003 Kanazawa
6,559,815 B1 * 5/2003 Kang et al. ..... 345/60
6,686,912 B1 * 2/2004 Kishi et al. ..... 345/211
6,972,739 B2 12/2005 Kim
7,391,389 B1 * 6/2008 Kawada et al. ..... 345/60
2002/0135545 A1 * 9/2002 Akiba ..... 345/60

(Continued)

FOREIGN PATENT DOCUMENTS

CN 1368717 A 9/2002

(Continued)

OTHER PUBLICATIONS

Machine Translation of KR-1020030027173.*

(Continued)

*Primary Examiner*—Regina Liang
*Assistant Examiner*—Jason M Mandeville
(74) *Attorney, Agent, or Firm*—Christie, Parker & Hale, LLP

(57) ABSTRACT

A plasma display panel and driving method thereof. Waveforms for performing a reset operation, an address operation, and a sustain operation are applied to a scan electrode while a sustain electrode is biased with a predetermined voltage, and it is controlled such that the absolute value of a positive voltage of sustain voltage pulses applied to the scan electrode in the sustain period may be greater than the absolute value of a negative voltage thereof. Further, an address electrode is floated when a waveform having a sustain discharge function is applied to the scan electrode, and the voltage at the address electrode is controlled to be increased and decreased according to the voltage at the scan electrode.

24 Claims, 8 Drawing Sheets

U.S. PATENT DOCUMENTS

| | | | | |
|---|---|---|---|---|
| 2005/0231442 | A1* | 10/2005 | Kim et al. | 345/60 |
| 2005/0264479 | A1* | 12/2005 | Ito et al. | 345/60 |
| 2006/0038750 | A1* | 2/2006 | Inoue et al. | 345/60 |
| 2007/0008249 | A1* | 1/2007 | Ito et al. | 345/67 |
| 2007/0159414 | A1* | 7/2007 | Cho | 345/60 |
| 2007/0216604 | A1* | 9/2007 | Kim et al. | 345/60 |

FOREIGN PATENT DOCUMENTS

| | | |
|---|---|---|
| JP | 60-196797 | 10/1985 |
| JP | 61-67094 | 4/1986 |
| JP | 8-123362 | 5/1996 |
| JP | 8-320667 | 12/1996 |
| JP | 9-68946 | 3/1997 |
| JP | 11-149274 | 6/1999 |
| JP | 11-184428 | 7/1999 |
| JP | 2000-122603 | 4/2000 |
| JP | 2000-194316 | 7/2000 |
| JP | 2000-242223 | 9/2000 |
| JP | 2001-35395 | 2/2001 |
| JP | 2001-75526 | 3/2001 |
| JP | 2002-62843 | 2/2002 |
| JP | 2002-62844 | 2/2002 |
| JP | 2002-215090 | 7/2002 |
| JP | 2002-278510 | 9/2002 |
| JP | 2003-50563 | 2/2003 |
| JP | 2003-271089 | 9/2003 |
| JP | 2004-39601 | 2/2004 |
| JP | 2004-77644 | 3/2004 |
| JP | 2004-163884 | 6/2004 |
| JP | 2004-200884 | 7/2004 |
| JP | 2004-215035 | 7/2004 |
| JP | 2004-291322 | 10/2004 |
| KR | 2001-0007548 | 1/2001 |
| KR | 2003-0006436 | 1/2003 |
| KR | 2003-0027173 | 4/2003 |
| KR | 2003-0090370 | 11/2003 |
| KR | 10-2004-0044035 | 5/2004 |
| KR | 10-2005-0037694 | 4/2005 |
| WO | WO 2004/032108 A1 | 4/2004 |

OTHER PUBLICATIONS

Korean Patent Abstracts for Publication No. 1020030006436; Date of publication of application Jan. 23, 2003, in the name of Dae Jin Myung.

Patent Abstracts of Japan for Publication No. 2000-242223; Date of publication application Sep. 8, 2000, in the name of Tetsuya Kato.

Korean Patent Abstracts for Publication No. 1020040044035, Date of publication of application May 27, 2004, in the name of Bong Chul Kim et al.

Korean Patent Abstracts for Publication No. 102-10007548, Date of publication of application Jan. 26, 2001, in the name of Tomokatsu Kishi et al.

Korean Patent Abstract, Publication No. 1020030090370 A, Published on Nov. 28, 2003, in the name Chae, et al.

Korean Patent Abstracts, Publication No. 1020030027173 A, dated Apr. 7, 2003, in the name of Seong Won Ji.

Translation of claims for JP 61-67094, dated Apr. 7, 1986, listed above.

Patent Abstracts of Japan, Publication No. 08-320667, dated Dec. 3, 1996, in the name of Giichi Kanazawa.

Patent Abstracts of Japan, Publication No. 11-149274, dated Jun. 2, 1999, in the name of Yasutaka Inanaga.

Patent Abstracts of Japan, Publication No. 11-184428, dated Jul. 9, 1999, in the name of Masayuki Shibata et al.

Patent Abstracts of Japan, Publication No. 2000-122603, dated Apr. 28, 2000, in the name of Hideyuki Asai et al.

Patent Abstracts of Japan, Publication No. 2000-194316 dated Jul. 14, 2000, in the name of Toyoshi Kawada et al.

Patent Abstracts of Japan, Publication No. 2001-035395, dated Feb. 9, 2001, in the name of Kyoung Ho Kang et al.

Patent Abstracts of Japan, Publication No. 2001-075526 dated Mar. 23, 2001, in the name of Makoto Onozawa et al.

Patent Abstracts of Japan, Publication No. 2002-062844, dated Feb. 28, 2002, in the name of Tomokatsu Kishi et al.

Patent Abstracts of Japan, Publication No. 2003-271089, dated Sep. 25, 2003, in the name of Tatsuhiko Kawasaki et al.

Patent Abstracts of Japan, Publication No. 2004-039601, dated Feb. 5, 2004, in the name of Yoshifumi Amano.

Patent Abstracts of Japan, Publication No. 08-123362, dated May 17, 1996, in the name of Hideyuki Asai et al.

Patent Abstracts of Japan, Publication No. 09-8946, dated Mar. 11, 1997, in the name of Giichi Kanazawa et al.

Patent Abstracts of Japan, Publication No. 2002-062843, dated Feb. 28, 2002, in the name of Tomokatsu Kishi et al.

Patent Abstracts of Japan, Publication No. 2002-278510, dated Sep. 27, 2002, in the name of Kunio Takayama et al.

Patent Abstracts of Japan, Publication No. 2004-077644, dated Mar. 11, 2004, in the name of Koichi Sakida.

Patent Abstracts of Japan, Publication No. 2002-215090, dated Jul. 31, 2002, in the name of Toru Ando et al.

Patent Abstracts of Japan, Publication No. 2003-050563, dated Feb. 21, 2003, in the name of Katsutoshi Shindo et al.

U.S. Office action dated Jan. 22, 2009, for related U.S. Appl. No. 11/107,463, including relevance of listed U.S. reference in this IDS.

Patent Abstracts of Japan, Publication No. 2004-163884, dated Jun. 10, 2004, in the name of Jong-Pil Park.

Patent Abstracts of Japan, Publication No. 2004-200884 dated Jul. 15, 2004, in the name of Takeshi Aihara.

Patent Abstracts of Japan, Publication No. 2004-215035, dated Jul. 29, 2004, in the name of Tomohiko Koto.

Patent Abstracts of Japan, Publication No. 2004-291322, dated Oct. 21, 2004, in the name of Yusuke Nakazawa.

* cited by examiner

PLASMA DISPLAY PANEL AND DRIVING METHOD THEREOF

CROSS REFERENCES TO RELATED APPLICATION

This application claims priority to and the benefit of Korean Patent Applications No. 10-2004-0026174, filed on Apr. 16, 2004, and No. 10-2004-0038275, filed on May 28, 2004, both at the Korean Patent Office, the entire contents of which are incorporated herein by reference.

BACKGROUND OF THE INVENTION

1. Field of the Invention

The present invention relates to a plasma display panel (PDP) driver, a driving method thereof, and a plasma display.

2. Description of the Related Art

The plasma display is a flat panel display that uses plasma generated via a gas discharge process to display characters or images, and tens to millions of pixels are provided thereon in a matrix format, depending on its size. Plasma displays are typically categorized as either DC plasma displays or AC plasma displays, according to supplied driving voltage waveforms and discharge cell structures.

Since DC plasma displays have electrodes exposed in the discharge space, they allow a current to flow in the discharge space while the voltage is supplied, and therefore they problematically require resistors for current restriction. On the other hand, since AC plasma displays have electrodes covered by a dielectric layer, capacitances are naturally formed to restrict current, and the electrodes are protected from ion shocks when discharging. Accordingly, they have a longer lifespan than the DC plasma displays.

FIG. 1 shows a perspective view of an AC PDP. As shown, a scan (Y) electrode 4 and a sustain (X) electrode 5, disposed over a dielectric layer 2 and a protection film 3, are provided in parallel and form a pair with each other under a first glass substrate 1. A plurality of address (A) electrodes 8 covered with an insulation layer 7 are installed on a second glass substrate 6. Barrier ribs 9 are formed in parallel with the address electrodes 8, on the insulation layer 7 between the address electrodes 8, and phosphor 10 is formed on the surface of the insulation layer 7 between the barrier ribs 9. The first and second glass substrates 1, 6 having a discharge space 11 between them are provided facing each other so that the scan electrode 4 and the sustain electrode 5 may respectively cross the address electrode 8. The address electrode 8 and a discharge space 11 formed at a crossing point of the scan electrode 4 and the sustain electrode 5 form a discharge cell 12.

FIG. 2 shows a PDP electrode arrangement diagram of the PDP shown in FIG. 1. The PDP electrodes have an m×n matrix configuration. Address (A) electrodes A1 to Am are located in a column direction, and scan (Y) electrodes Y1 to Yn and sustain (X) electrodes X1 to Xn are located in a row direction, alternately. The discharge cell 12 shown in FIG. 2 corresponds to the discharge cell 12 shown in FIG. 1.

In a typical AC PDP driving method a frame is divided into a plurality of subfields and includes a reset period, an address period, and a sustain period. In the reset period, the discharge cells are reset in order to stably perform an address operation. In the address period, the cells that are turned on and the cells that are not turned on are selected on the panel, and wall charges are accumulated on the cells that are turned on (i.e., the addressed cells). In the sustain period, a discharge for actually displaying pictures on the addressed cells is performed.

In order to perform these operations, a sustain discharge pulse is alternately applied to the scan electrode and sustain electrode in the sustain period, and a reset waveform and a scan waveform are applied to the scan electrode while the sustain electrode is biased with a predetermined voltage in the reset period and the address period. Typically, a scan driving board for driving the scan electrodes and a sustain driving board for driving the sustain electrodes are separately provided, which generates a problem of installing the driving boards in the chassis base and increases the cost.

Accordingly, a method for combining the two boards into a single board to provide the same to one side of the scan electrode, and extending one terminal of the sustain electrode to reach the combined board has been proposed, but the combination increases the impedance formed at the extended sustain electrode.

To solve the problem, Korean laid-open application No. 10-2003-90370 has disclosed a method for applying a sustain discharge pulse by a scan electrode driver and minimizing a sustain electrode driver.

FIG. 3 shows a conventional PDP driving waveform in a sustain period. Voltages Vs and −Vs for a sustain discharge are alternately applied to the scan (Y) electrode (or sustain (X) electrode) in the sustain period, and the voltage at the sustain electrode (or scan electrode) is maintained at the ground voltage.

In this instance, since very few wall charges are accumulated on the cells which are not selected in the address period when the conditions for all the discharge cells are the same, no discharge is generated between the scan electrodes and the address electrodes of the discharge cells which are not selected when the voltages Vs and −Vs are applied to the scan electrode in the sustain period.

However, a misfiring may be generated between the scan electrode and the address electrode of the non-selected cells in the address period because of unstable wall charge states between the discharge cells when the voltages Vs and −Vs are applied to the scan electrode in the sustain period.

Therefore, in order to prevent the misfiring between the address electrode and the scan electrode in the prior art, the address electrode is floated in the sustain period or an address voltage Va is applied to the address electrode when the voltage Vs is applied to the scan electrode, thereby reducing the voltage difference between the address electrode and the scan electrode.

The above-described prior art reduces the voltage difference between the scan electrode and the address electrode when positive wall charges are accumulated on the scan electrodes of discharge cells which are not selected in the address period and the voltage Vs is applied to the scan electrode in the sustain period. However, a misfiring may be generated since the voltage difference between the scan electrode and the address electrode may be greater than a firing voltage when negative wall charges are accumulated on the scan electrodes of discharge cells which are not selected in the address period and the negative voltage −Vs is applied to the scan electrode in the sustain period.

SUMMARY OF THE INVENTION

In accordance with the present invention a driving waveform of a misfiring preventing PDP with an integrated board for driving scan (Y) electrodes and sustain (X) electrodes is provided.

In one aspect of the present invention, a method is provided for dividing a frame into a plurality of subfields and driving the same in a plasma display panel including a plurality of first electrodes, second electrodes, and address (A) electrodes. In at least one subfield: (a) a reset waveform is applied to the first electrode in order to establish a discharge cell to be addressed while the second electrode is biased with a first voltage; (b) a second voltage is sequentially applied to the first electrode while the second electrode is biased with the first voltage; (c) a third voltage which is greater than the first voltage is applied to the first electrode for the purpose of a sustain discharge while the second electrode is biased with the first voltage; and (d) a fourth voltage which is less than the first voltage is applied to the first electrode for the purpose of a sustain discharge while the second electrode is biased with the first voltage. The absolute value of the difference between the first voltage and the third voltage is greater than the absolute value of the difference between the first voltage and the fourth voltage.

The voltage at the address electrode is increased to a fifth voltage in (c), and the voltage at the address electrode is maintained to be a sixth voltage which is less than the fifth voltage in (d).

The fifth voltage and the sixth voltage are applied to the address electrode respectively, and the address electrode is floated in (c) and (d).

In another aspect of the present invention, a method is provided for driving a plasma display panel including a plurality of first electrodes, second electrodes, and address electrodes. In a sustain period, a second voltage which is greater than a first voltage is applied to the first electrode while the second electrode is biased with the first voltage; and a third voltage which is less than the first voltage is applied to the first electrode while the second electrode is biased with the first voltage. A fourth voltage which is a voltage at the address electrode when the second voltage is applied to the first electrode does not correspond to a fifth voltage which is a voltage at the address electrode when the third voltage is applied to the first electrode. The absolute value of the difference between the first voltage and the second voltage is greater than the absolute value of the difference between the first voltage and the third voltage.

The fourth voltage is greater than the fifth voltage, and the address electrode is floated.

In still another aspect of the present invention, a plasma display panel having a panel and a driving circuit is provided. The panel includes a plurality of first electrodes, second electrodes, and address electrodes, and the driving circuit alternately applies a positive first voltage and a negative second voltage to the first electrode in a sustain period, and controls the voltage at the address electrode when the first voltage is applied to the first electrode to be greater than the voltage at the address electrode when the second voltage is applied to the first electrode, and an absolute value of the negative second voltage is less than an absolute value of the positive first voltage. The driving circuit maintains the voltage at the second electrode to be a ground voltage, floats the address electrode, and maintains the voltage at the second electrode to be a ground voltage in a reset period and an address period.

In still yet another aspect of the present invention, a method is provided for dividing a frame into a plurality of subfields and driving the same in a plasma display panel including a plurality of first electrodes, second electrodes, and third electrodes. In at least one subfield, a discharge cell to be turned on is selected in an address period, and a second- voltage which is greater than a first voltage and a third voltage which is less than the first voltage are alternately applied to the second electrode while the first electrode is biased with the first voltage in a sustain period. The third electrode is floated while the third voltage is applied to the second electrode in the sustain period. A fourth voltage is applied to the third electrode of the discharge cell to be turned on and a fifth voltage which is less than the fourth voltage is applied to the third electrode of the discharge cell which is not turned on in the address period, and the third electrode is decoupled from a power source for supplying the fifth voltage when the third electrode is floated.

DETAILED DESCRIPTION

Figure 4:
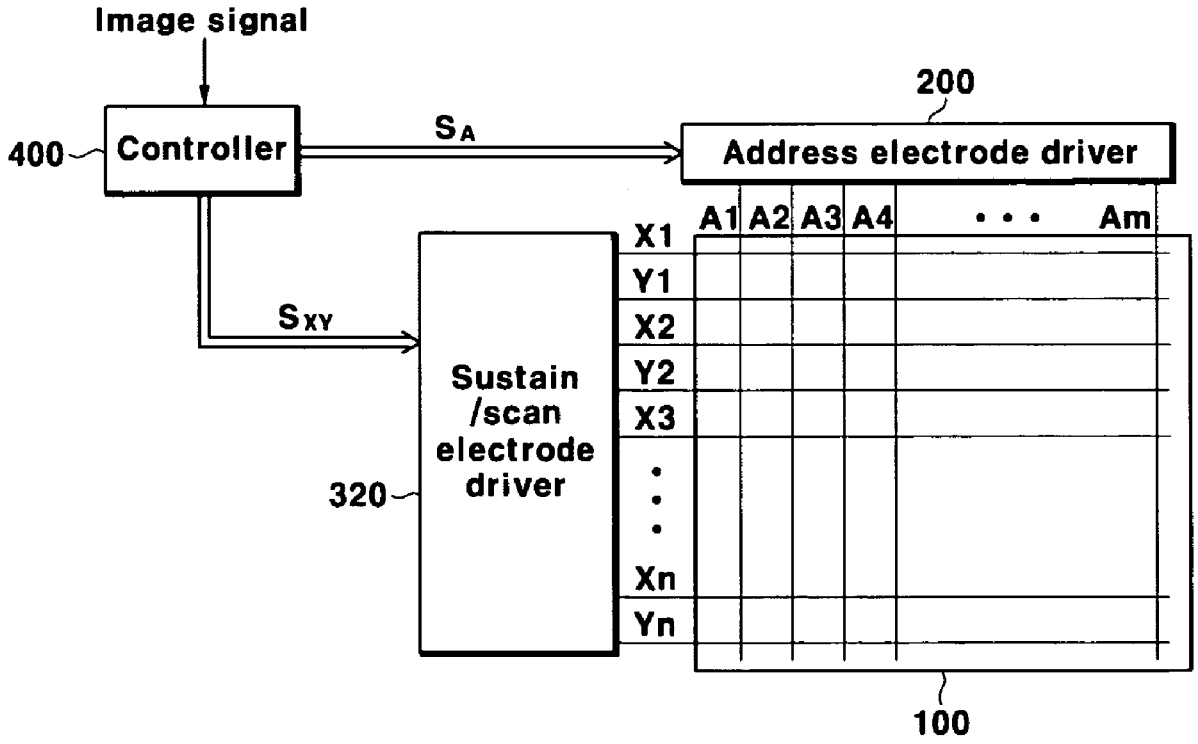
FIG. 4 shows a PDP according to an exemplary embodiment of the present invention.

Referring now to FIG. 4, a PDP according to an exemplary embodiment of the present invention includes a plasma panel 100, an address (A) electrode driver 200, a sustain scan (XY) electrode driver 320, and a controller 400.

The plasma panel 100 includes a plurality of address (A) electrodes A1 to Am arranged in a column direction, and a plurality of first electrodes Y1 to Yn (also referred to collectively as Y electrodes) and second electrodes X1 to Xn (also referred to collectively as X electrodes) arranged in a row direction.

The address electrode driver 200 receives an address drive control signal $S_A$ from the controller 400, and applies display data signals for selecting discharge cells to be displayed to the respective address electrodes pursuant to an image signal applied to controller 400.

The sustain scan (XY) electrode driver 320 receives an XY electrode drive signal $S_{XY}$ from the controller 200 and applies the signal to the X and Y electrodes. The controller 400 receives external image signals, generates the address drive control signal $S_A$ and the XY electrode drive signal $S_{XY}$, and respectively transmits the signals $S_A$ and $S_{XY}$ to the address electrode driver 200 and the sustain scan (XY) electrode driver 320.

A PDP driving method will now be described with reference to FIG. 5, which shows a driving waveform applied to the PDP according to a first exemplary embodiment of the present invention. A subfield includes a reset period, an address period, and a sustain period, and the voltage at the sustain (X) electrode is maintained at 0V in the reset period, the address period, and the sustain period.

In the reset period, the voltage Vs is applied to the scan (Y) electrode, and a voltage which gradually rises to the voltage Vset is applied to the scan electrode. A weak discharge is generated between the scan electrode and the sustain electrode to form negative wall charges on the scan electrode and positive wall charges on the sustain electrode. The voltage at the scan electrode is reduced to the voltage Vs, and a voltage which gradually falls to the voltage −Vnf is applied to the scan electrode. A weak discharge is generated between the scan electrode and the sustain electrode to erase most of the negative wall charges formed on the scan electrode and the positive wall charges formed on the sustain electrode.

In the address period, the levels of scan voltages applied to the Y electrode are reduced by as much as the bias voltage applied to the X electrode in the address period instead of applying the bias voltage to the X electrode in order to maintain the voltages at the X and Y electrodes to be 0V and maintain the voltage difference between the X and Y electrodes.

That is, the voltage −VscL is applied to the selected scan electrode while the non-selected scan electrode is biased with the voltage −VscH, and the positive voltage Va is applied to the address (A) electrode which is passed through a discharge cell to be turned on from among discharge cells formed on the selected scan electrode. A discharge is generated between the address electrode to which the voltage Va is applied and the scan electrode to which the voltage −VscL is applied and a discharge is generated between the scan electrode and the sustain electrode so that wall charges for a sustain discharge in the sustain period are formed.

In the sustain period, pulses with the voltages of +Vs1 and −Vs2 are alternately applied to the scan electrode to generate a sustain discharge between the scan electrode and the sustain electrode, and float the address electrode in the sustain period.

In the case in which the absolute values of the voltages of +Vs1 and −Vs2 correspond to each other, a misfiring may be generated since the voltage difference between the scan electrode and the address electrode becomes greater than the firing voltage, when the negative wall charges are accumulated on the scan electrode of the discharge cell which is not selected in the address period and the negative voltage −Vs is applied to the scan electrode in the sustain period.

Figure 5:
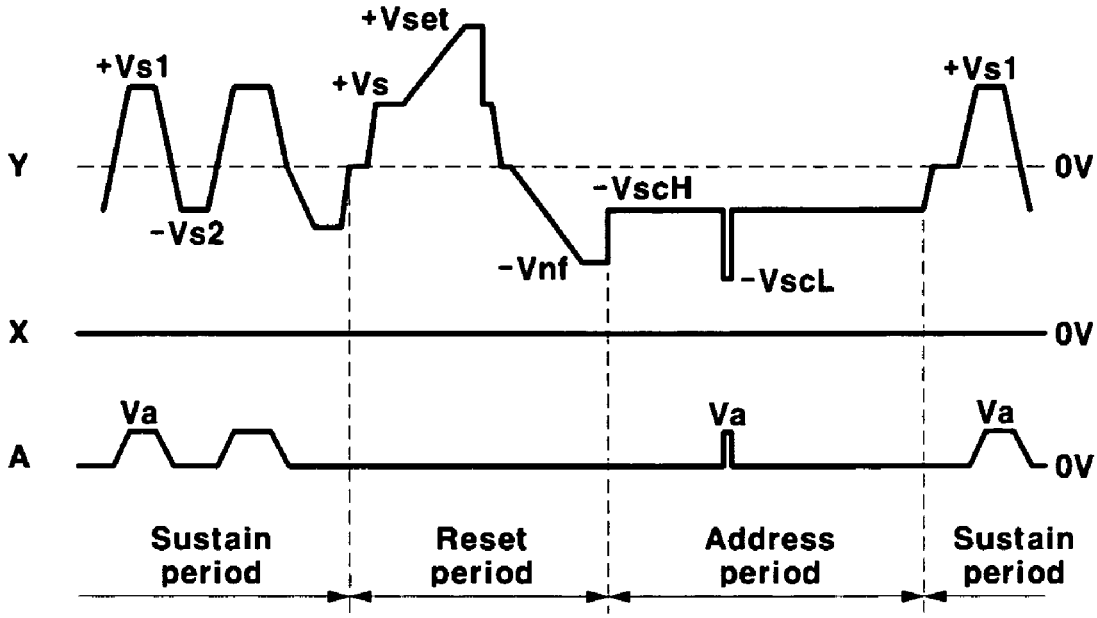
FIG. 5 shows a PDP driving waveform according to a first exemplary embodiment of the present invention.

As shown in FIG. 5, therefore, the absolute value of the voltage +Vs1 is established to be greater than the absolute value of the voltage −Vs2 while the voltage difference between the voltages of +Vs1 and −Vs2 is maintained at the voltage 2Vs.

Figure 6:
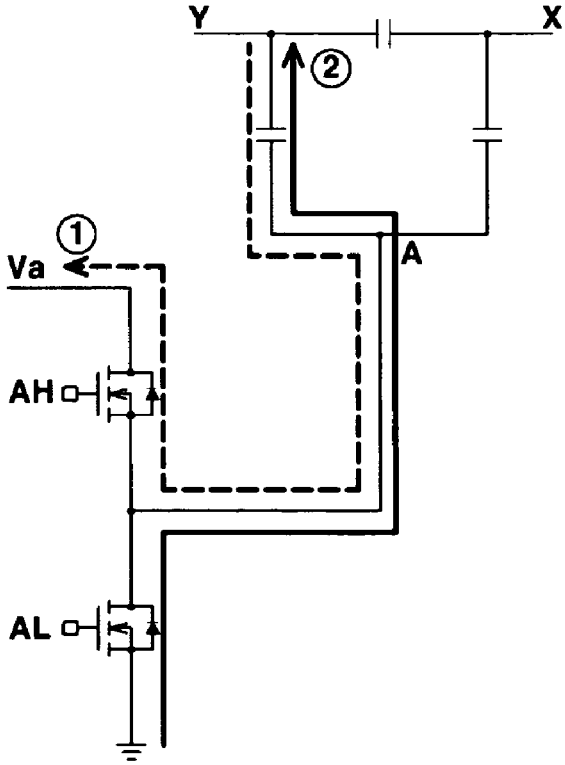
FIG. 6 shows a sustain (X) electrode, a scan (Y) electrode, and address (A) electrode, and an address selecting circuit coupled to the address electrode according to a first exemplary embodiment of the present invention.

Referring now to FIGS. 6 and 7, an output waveform at the address (A) electrode when the address electrode is floated in the sustain period will be described in more detail.

Figure 7A:
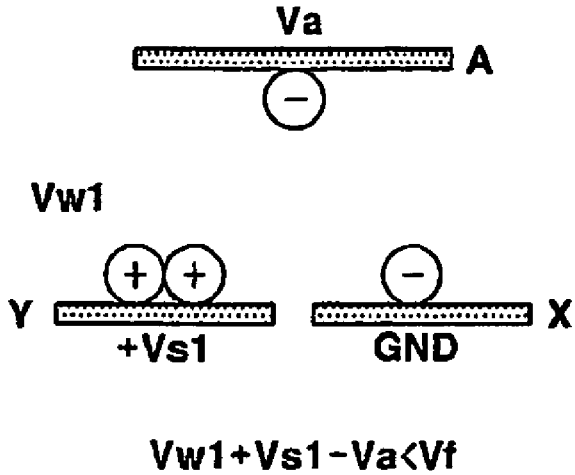
FIGS. 7A and 7B show wall charge states of discharge cells according to the driving waveform of the first exemplary embodiment of the present invention.
Figure 7B:
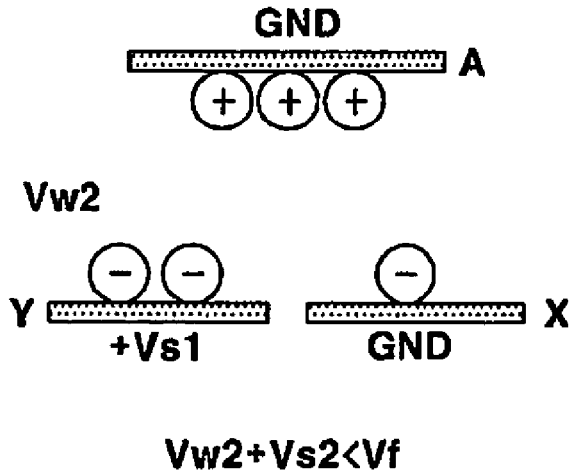

FIG. 6 shows a sustain (X) electrode, a scan (Y) electrode, and an address (A) electrode, and an address selecting circuit coupled to the address electrode according to a first exemplary embodiment of the present invention. FIGS. 7A and 7B show wall charge states of discharge cells according to the driving waveform according to a first exemplary embodiment of the present invention. The address selecting circuit of FIG. 6 includes a driving transistor AH and a ground transistor AL, and each transistor has a body diode.

As shown in FIG. 6, since a panel capacitor is formed between the scan (Y) electrode and the address (A) electrode, the potential of the scan electrode is increased and the potential of the address electrode is increased when the voltage +Vs1 is applied to the scan electrode while the output of the address electrode is floated in the sustain period. When the potential at the address electrode is increased to be greater than the voltage Va, the voltage at the address electrode is clamped with the voltage Va through the body diode of the driving transistor AH of the address selecting circuit (as given by the path (1) of FIG. 6). Hence, the voltage at the address electrode is maintained at the voltage Va when the voltage at the scan electrode is increased to be greater than the voltage Va.

In this instance, the difference between the voltage Va at the address electrode and the sum of the wall voltage Vw1 at the scan electrode and the voltage +Vs1 applied to the scan electrode is reduced to be less than the firing voltage Vf between the address electrode and the scan electrode and no misfiring is accordingly generated (as illustrated in FIG. 7A) since the voltage at the address electrode is floated with the voltage Va when the positive wall charges are accumulated on the scan electrode of discharge cells which are not selected in the address period and the voltage +Vs1 greater than the voltage Vs is applied to the scan electrode in the sustain period. Also, no misfiring is generated between the scan electrode and the address electrode since the voltage at the scan electrode is reduced because of an offset of negative wall charges and the voltage +Vs1 applied to the scan electrode when the negative wall charges are accumulated on the scan electrode.

Further, the potential at the scan electrode is reduced and the potential at the address electrode is reduced when the voltage −Vs2 is applied to the scan electrode while the output of the address electrode is floated in the sustain period. The voltage at the address electrode is clamped with 0V (as illustrated by the path (2) of FIG. 6) through the body diode of the driving transistor AL of the address selecting circuit when the potential at the address electrode is reduced to be less than 0V. Therefore, the voltage at the address electrode is maintained at 0V when the voltage at the scan electrode is reduced to be less than 0V.

In this instance, the difference between the wall voltage Vw1 at the scan electrode and the voltage −Vs2 applied to the scan electrode is less than the firing voltage Vf between the address electrode and the scan electrode and no misfiring is accordingly generated (as illustrated in FIG. 7B) since the absolute value of the voltage −Vs2 is less than the voltage Vs when the negative wall charges are accumulated on the scan electrode of discharge cells which are not selected in the address period and the voltage −Vs2 is applied to the scan electrode in the sustain period. Also, no misfiring is generated between the scan electrode and the address electrode since the voltage at the scan electrode is reduced because of an offset of positive wall charges and the voltage −Vs2 applied to the scan electrode when the positive wall charges are accumulated on the scan electrode.

The voltage +Vs1 is to be less than the firing voltage between the sustain electrode and the scan electrode so that no sustain discharge may be generated at the discharge cells which are not addressed in the address period. Also, the voltage −Vs2 must have a value such that the voltage −Vs2 together with the wall voltage of the addressed discharge cells may generate a discharge. In this instance, the voltages of +Vs1 and −Vs2 can be controlled within a range in which the difference between the voltages of +Vs1 and −Vs2 corresponds to the difference between the conventional voltages of +Vs and −Vs.

The address electrode is floated in the sustain period according to the first exemplary embodiment. In addition, the address electrode can be floated when the voltage pulse of +Vs1 is applied to the scan electrode in the sustain period, and differing from this, the voltage pulse of Va can be directly applied to the address electrode.

The sustain electrode is biased with 0V while the driving waveform is applied to the scan electrode in the first exemplary embodiment, and in addition, it is also possible to bias the sustain electrode with another voltage and modify the driving waveform of the scan electrode by as much as the voltage difference between the other voltage and 0V.

Further, the voltages of −Vs2 and +Vs1 have been alternately applied to the scan electrode in the sustain period in the first exemplary embodiment, and in addition, it is possible to increase the voltage at the scan electrode from the voltage −Vs2 to 0V, increase the voltage from 0V to the voltage +Vs1, reduce the voltage from the voltage +Vs1 to 0V, and reduce the voltage from 0V to the voltage −Vs2.

The voltages of −Vs2 and +Vs1 have been alternately applied to the scan electrode in the sustain period in the first exemplary embodiment, and in addition, it is possible to alternately apply the voltages of Vs and −Vs to the scan electrode in the sustain period and float the address electrode when the voltage −Vs is applied to the scan electrode.

Figure 8:
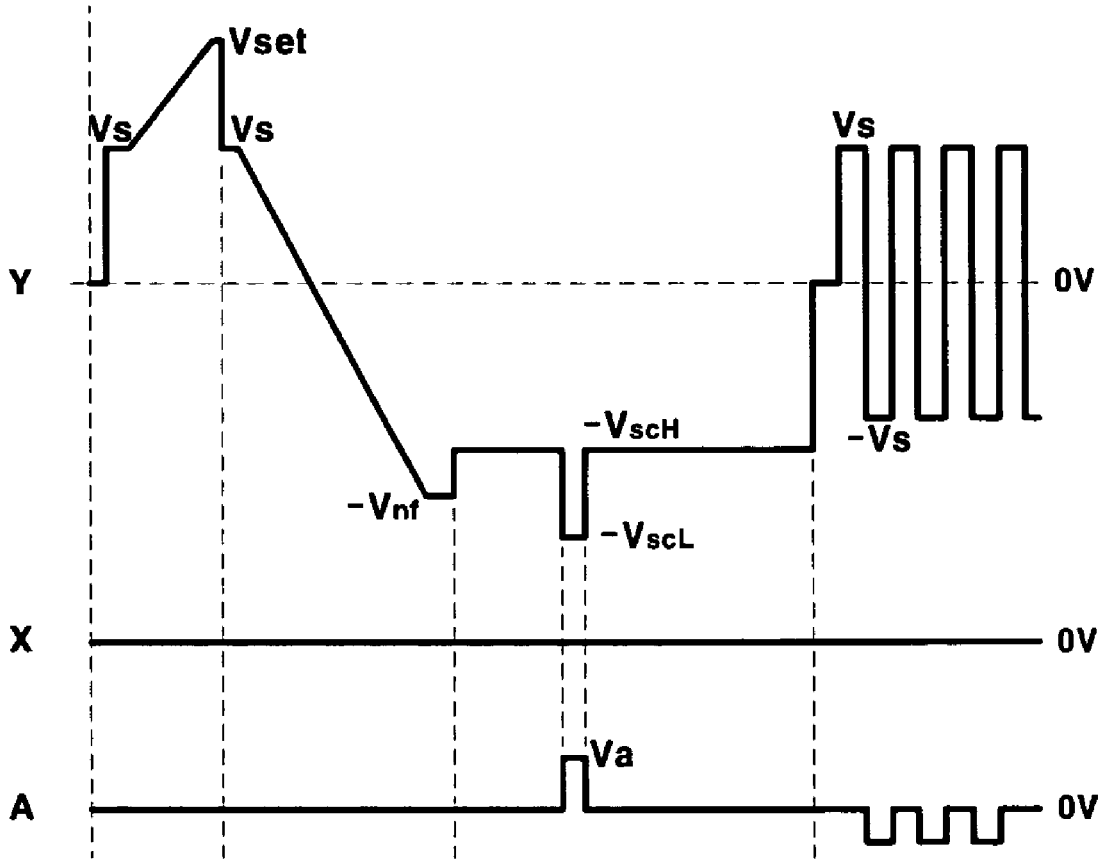
FIG. 8 shows a PDP driving waveform according to a second exemplary embodiment of the present invention.

FIG. 8 shows a PDP driving waveform according to a second exemplary embodiment of the present invention. Pulses with the voltages of Vs and −Vs are alternately applied to the scan (Y) electrode in the sustain period, and the address (A) electrode is floated when the voltage −Vs is applied to the scan electrode. Since a capacitance component is formed by the address electrode and the scan electrode, the voltage at the address electrode is reduced together with the voltage at the scan electrode when the voltage at the scan electrode is reduced and the address electrode is floated. Therefore, a misfiring between the scan electrode and the address electrode of the cell which is not selected in the address period is prevented since the voltage between the address electrode and the scan electrode is reduced to be less than the voltage of the case in which the voltage Vs and −Vs are alternately applied to the scan electrode, when the voltage −Vs is applied to the Y electrode.

Figure 1:
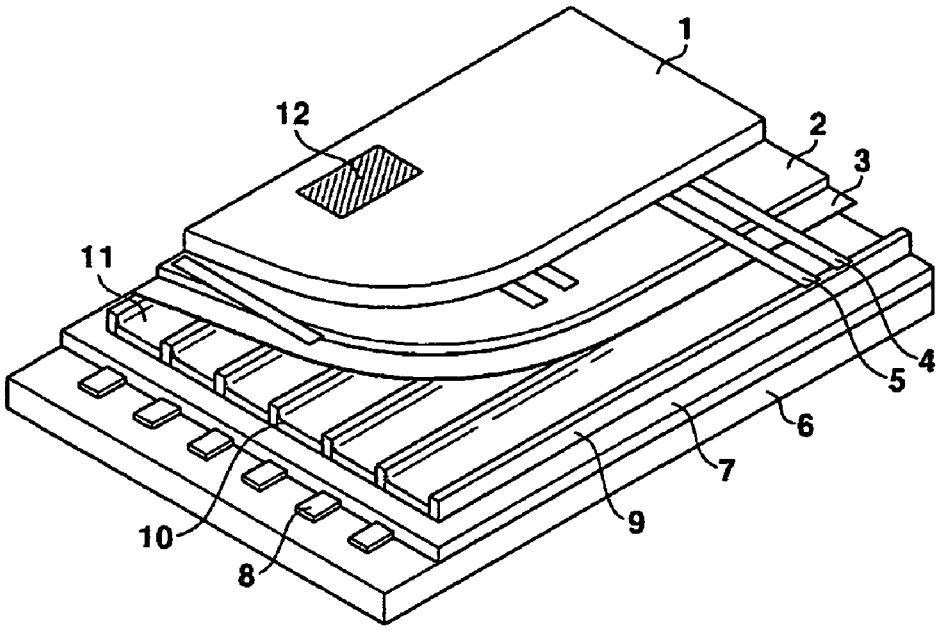
FIG.1 (Prior Art)
FIG. 1 shows a perspective view of an AC PDP.
Figure 2:
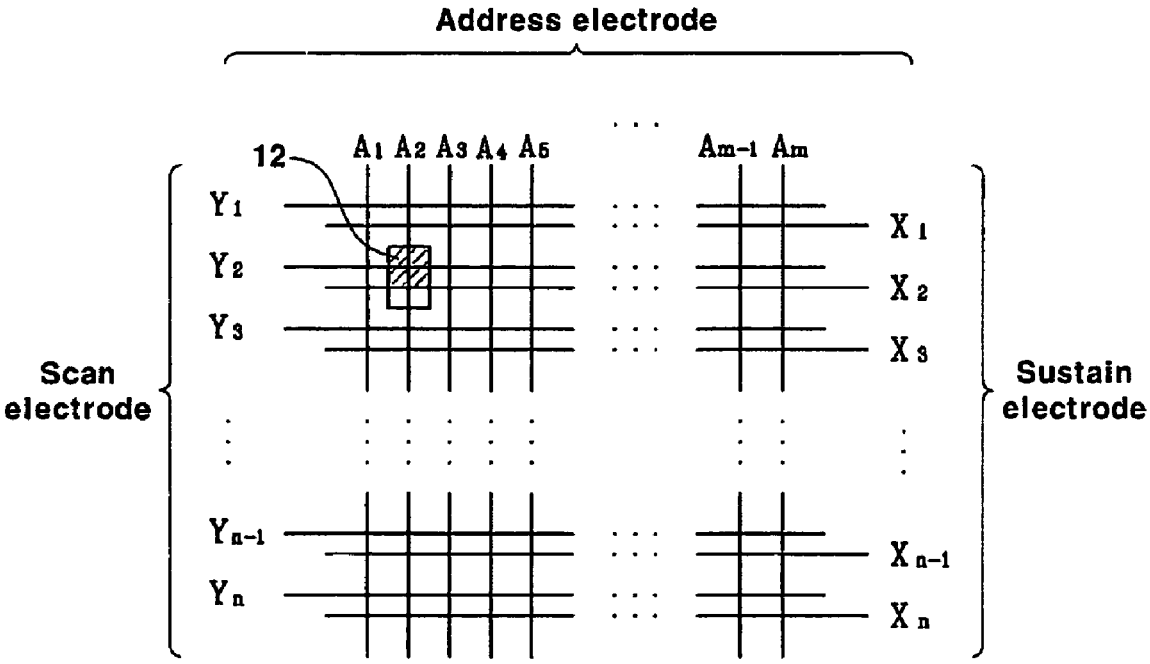
FIG.2 (Prior Art)
FIG. 2 shows a PDP electrode arrangement diagram.
Figure 3:
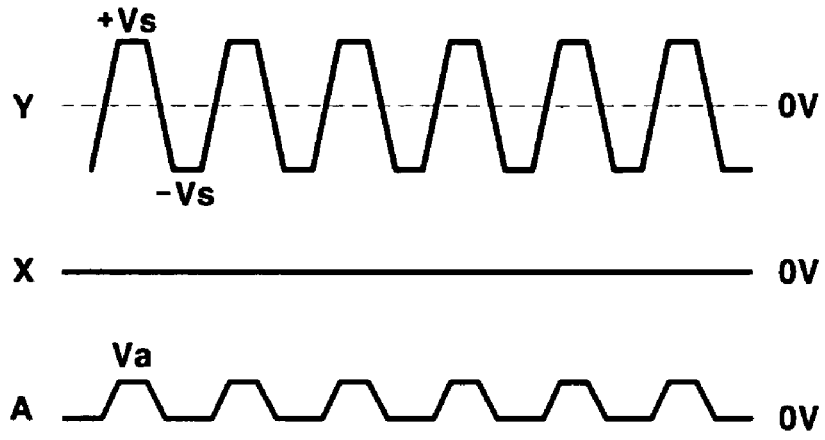
FIG.3 (Prior Art)
FIG. 3 shows a conventional PDP driving waveform in a sustain period.

When the voltage −Vs is applied to the scan electrode in the sustain period and the address electrode is floated as shown in FIG. 8, the voltage at the address electrode is reduced following the voltage at the scan electrode, and when the voltage at the address electrode is reduced to be less than the ground voltage, the voltage at the address electrode is clamped with the ground voltage through the body diode of the transistor AL of the address selecting circuit. Therefore, the voltage at the address electrode cannot be reduced below the ground voltage, and hence, the driving waveform shown in FIG. 8 cannot be provided since the driving waveform corresponds to that of FIG. 3.

Figure 9:
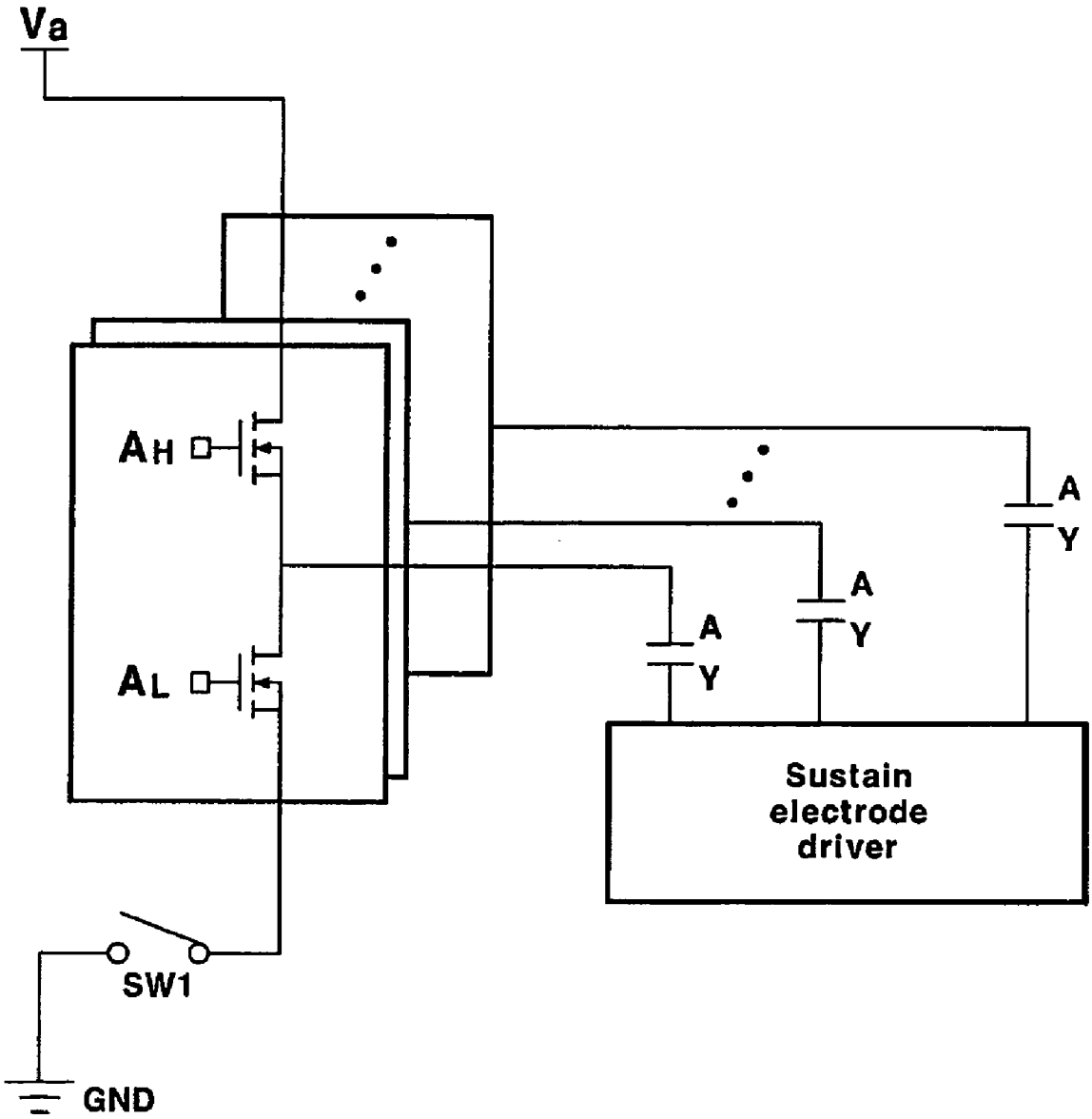
FIG. 9 shows an address selecting circuit according to a second exemplary embodiment of the present invention.

Therefore, a switch SW1 is coupled between the transistor AL and the ground voltage GND in the second exemplary embodiment. FIG. 9 shows an address selecting circuit according to a second exemplary embodiment of the present invention. Switch SW1 is coupled between the address selecting circuit and the ground voltage 0V. When the voltage −Vs is applied to the scan (Y) electrode and the address (A) electrode is floated in the sustain period, the switch SW1 is turned off to intercept the address electrode from the ground voltage 0V and allow the voltage at the address electrode to be reduced according to the voltage at the scan electrode.

When the voltage −Vs is applied to the scan electrode in the sustain period in the second exemplary embodiment, the voltage at the address electrode is reduced to be a negative voltage to thus decrease the voltage difference between the scan electrode and the address electrode and accordingly prevent a misfiring from being generated at the discharge cell which is not selected in the address period.

Since the driving waveform according to the second exemplary embodiment floats the address electrode when the voltage −Vs is applied to the scan electrode, the switch SW1 is repeatedly turned on and off to thus increase power consumption. Also, when the voltage Vs is applied to the scan electrode to generate a discharge, the electrons are moved to the scan electrode and the positive ions are moved to the address electrode. The address electrode is coated with a phosphor for color representation, and the positive ions collide with the phosphor surface to shorten the phosphor's lifetime.

Figure 10:
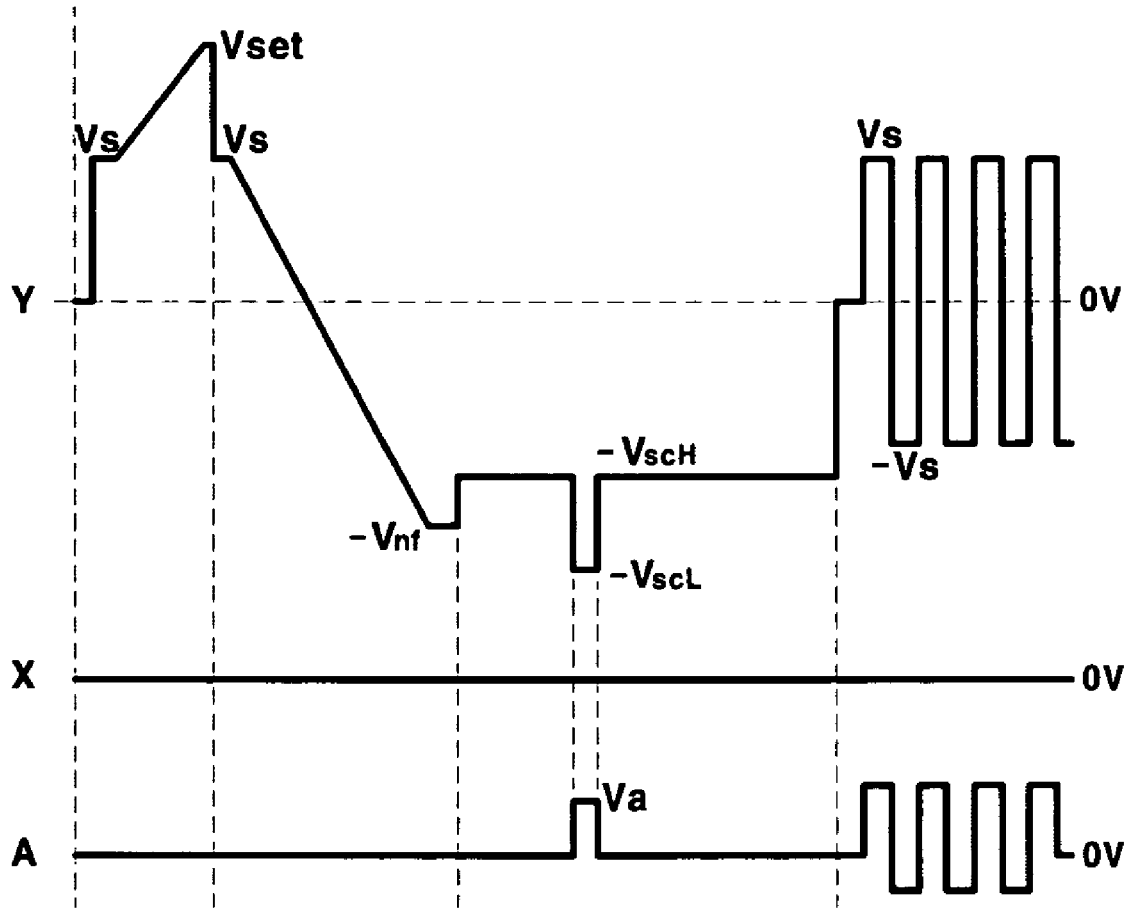
FIG. 10 shows a PDP driving waveform according to a third exemplary embodiment of the present invention.

Accordingly, a method for overcoming the problem will now be described with reference to FIG. 10, which shows a PDP driving waveform according to a third exemplary embodiment of the present invention. The address (A) electrode is floated when the voltage Vs is applied to the scan electrode in the sustain period in the third exemplary embodiment. That is, the address electrode is floated and the sustain discharge pulses alternately having the voltages of Vs and −Vs are applied to the scan electrode in the sustain period.

The voltage at the address electrode is increased according to the voltage at the scan electrode when the voltage Vs is applied to the scan electrode and the address electrode is floated. Therefore, the potential at the address electrode is increased, a large amount of positive ions are moved to the sustain (X) electrode after a sustain discharge, and hence, the phosphor covering the address electrode is protected.

When the driving waveform according to the third embodiment is generated by using the general address selecting circuit shown in FIG. 6, the voltage at the address (A) electrode is increased according to the voltage at the address electrode to be clamped with the voltage Va.

Therefore, the path of the voltage Va and the address electrode is to be intercepted in order to supply a voltage greater than the voltage Va to the address electrode in a like manner of a third exemplary embodiment.

Figure 11:
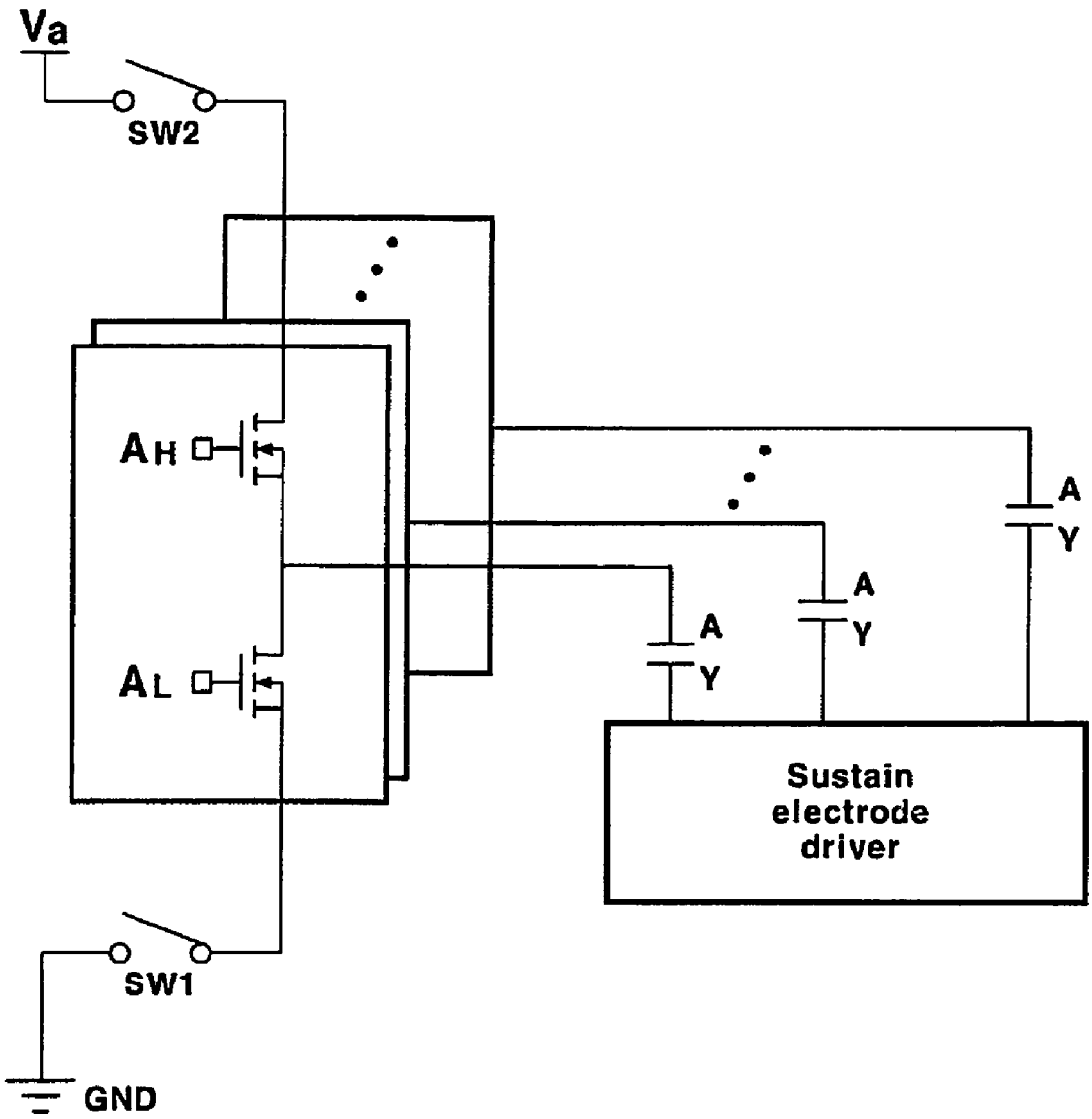
FIG. 11 shows an address selecting circuit according to a third exemplary embodiment of the present invention.

FIG. 11 shows an address selecting circuit according to a third exemplary embodiment of the present invention. The address selecting circuit according to the third exemplary embodiment corresponds to the address selecting circuit of FIG. 9 except that a switch SW2 is coupled between the voltage Va and an address IC.

A method for applying the driving waveform according to the third exemplary embodiment through the address selecting circuit will now be described.

When the address (A) electrode is floated and the voltage Vs is applied to the scan (Y) electrode by turning off the switches SW1 and SW2, the voltage at the address electrode is increased to be a positive voltage, and when the voltage −Vs is applied to the scan electrode, the voltage at the address electrode is reduced to be a negative voltage. In this instance, since the switches SW1 and SW2 are turned off and the address electrode is intercepted from the voltages of 0V and Va, a voltage greater than the voltage Va is applied when the voltage Vs is applied to the scan electrode, and a voltage less than the voltage 0V is applied when the voltage −Vs is applied to the scan electrode.

As described, the sustain (X) electrode driving board is eliminated by biasing the sustain electrode with a predetermined voltage, applying a driving waveform to the scan electrode, and thereby performing a reset operation, an address operation, and a sustain discharge operation. Also, the impedance on the path through which the sustain discharge pulses are applied is established to be constant since the pulses for the sustain discharge are applied to the scan electrode driving board.

The reset periods of subfields forming a frame can respectively have a rising period and a falling period as described in the first to third exemplary embodiments, and in addition, the reset periods of some subfields can respectively have a falling period.

The sustain electrode is biased with a predetermined voltage in the whole driving periods, but the present invention is not restricted to this.

According to the present invention, the sustain electrode driving board is removed since the driving waveform is applied to the scan electrode while the sustain electrode is biased with a constant voltage.

Further, the generation of misfiring at the discharge cell which is not selected in the address period is solved by controlling the absolute value of the positive voltage to be greater than the absolute value of the negative voltage in the sustain voltage pulse applied to the scan electrode (or sustain electrode) in the sustain period and thus reducing the voltage difference between the address electrode and the scan electrode (or sustain electrode).

The misfiring in the sustain period is prevented by floating the address electrode in the sustain period, adding a switch between respective power sources for supplying an address voltage and a non-address voltage applied to the address electrode in the address period and an address IC, and increasing the voltage to be greater than the address voltage or decreasing the same to be less than the address voltage when floating the address electrode in the sustain period.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for dividing a frame into a plurality of subfields and driving the same in a plasma display panel having a plurality of first electrodes, second electrodes, and address electrodes, comprising:

in at least one subfield, (a) applying a reset waveform to the first electrode to establish a discharge cell to be addressed while the second electrode is biased with a first voltage, in a reset period;

(b) sequentially applying a second voltage to the first electrode while the second electrode is biased with the first voltage, in an address period;

(c) applying a third voltage which is greater than the first voltage to the first electrode for a sustain discharge while the second electrode is biased with the first voltage, in a sustain period; and (d) applying a fourth voltage which is less than the first voltage to the first electrode for a sustain discharge while the second electrode is biased with the first voltage, in the sustain period, wherein an absolute value of the difference between a peak value of the third voltage and the first voltage, in the sustain period, is greater than an absolute value of the difference between a peak value of the fourth voltage and the first voltage, in the sustain period, and wherein the first voltage is a ground voltage.

2. The method of claim 1, wherein applying the third voltage includes increasing the voltage at the address electrode to a fifth voltage, and applying the fourth voltage includes maintaining the voltage at the address electrode to be a sixth voltage which is less than the fifth voltage.

3. The method of claim 2, wherein applying the third voltage and applying the fourth voltage include applying the fifth voltage and the sixth voltage to the address electrode respectively.

4. The method of claim 1, wherein applying the third voltage and applying the fourth voltage include floating the address electrode.

5. The method of claim 2, wherein the sixth voltage is a ground voltage.

6. The method of claim 2, wherein the sixth voltage corresponds to the first voltage.

7. A method for driving a plasma display panel having a plurality of first electrodes, second electrodes, and address electrodes, comprising:

in a sustain period, applying a second voltage which is greater than a first voltage to the first electrode while the second electrode is biased with the first voltage; and applying a third voltage which is less than the first voltage to the first electrode while the second electrode is biased with the first voltage, wherein a fourth voltage which is a voltage at the address electrode when the second voltage is applied to the first electrode does not correspond to a fifth voltage which is a voltage at the address electrode when the third voltage is applied to the first electrode, wherein an absolute value of the difference between a peak value of the second voltage and the first voltage, in the sustain period, is greater than an absolute value of the difference between a peak value of the third voltage and the first voltage, in the sustain period, and wherein the first voltage is a ground voltage.

8. The method of claim 7, wherein the fourth voltage is greater than the fifth voltage.

9. The method of claim 7, wherein the address electrode is floated.

10. The method of claim 7, wherein the second electrode is biased with the first voltage in a reset period and an address period.

11. A plasma display panel comprising:

a panel having a plurality of first electrodes, second electrodes, and address electrodes; and a driving circuit for alternately applying a positive first voltage and a negative second voltage to a first electrode in a sustain period while applying a reference voltage to the second electrodes, and controlling the voltage at an address electrode when the positive first voltage is applied to the first electrode to be greater than the voltage at the address electrode when the negative second voltage is applied to the first electrode, wherein an absolute value of the difference between a peak value of the negative second voltage and the reference voltage, in the sustain period, is less than an absolute value of the difference between a peak value of the positive first voltage and the reference voltage, in the sustain period, and wherein the reference voltage is a ground voltage.

12. The plasma display panel of claim 11, wherein the driving circuit maintains the voltage at a second electrode to be a ground voltage.

13. The plasma display panel of claim 11, wherein the driving circuit floats the address electrode.

14. The plasma display panel of claim 11, wherein the driving circuit maintains the voltage at a second electrode to be a ground voltage in a reset period and an address period.

15. A method for dividing a frame into a plurality of subfields and driving the frame in a plasma display panel having a plurality of first electrodes, second electrodes, and third electrodes, comprising:

in at least one subfield, selecting a discharge cell to be turned on in an address period; and alternately applying a second voltage which is greater than a first voltage and a third voltage which is less than the first voltage to a second electrode while a first electrode is biased with the first voltage in a sustain period, wherein an absolute value of the difference between a peak value of the second voltage and the first voltage in the sustain period, is greater than an absolute value of the difference between a peak value of the third voltage and the first voltage in the sustain period, wherein a third electrode is floated to a voltage less than the first voltage while the third voltage is applied to the second electrode in the sustain period, and wherein the first voltage is a ground voltage.

16. The method of claim 15, wherein a fourth voltage is applied to the third electrode of the discharge cell to be turned on and a fifth voltage which is less than the fourth voltage is applied to the third electrode of the discharge cell which is not turned on in the address period, and the third electrode is decoupled from a power source for supplying the fifth voltage when the third electrode is floated.

17. The method of claim 16, wherein the third electrode is floated in the sustain period.

18. The method of claim 17, wherein the third electrode is decoupled from the power source for supplying the fourth voltage while the second voltage is applied to the second electrode in the sustain period.

19. The method of claim 15, wherein the first electrode is biased with the first voltage in a reset period and an address period.

20. The method of claim 16, wherein the fifth voltage is a ground voltage.

21. A plasma display panel comprising:

a panel having a plurality of first electrodes, second electrodes, and third electrodes crossing the first and second electrodes;

a plurality of selection circuits for selectively applying a first voltage to a third electrode of a discharge cell to be turned on in an address period, and applying a second voltage which is less than the first voltage to the third electrode which will not be turned on; and a driving circuit for, in a sustain period, alternately applying a fourth voltage which is greater than a third voltage and a fifth voltage which is less than the third voltage to the first electrode while the voltage at the second electrode is maintained at the third voltage, and floating the third electrode to a voltage less than the third voltage while the fifth voltage is applied to the first electrode, wherein an absolute value of the difference between a peak value of the fourth voltage and the third voltage in the sustain period, is greater than an absolute value of the difference between a peak value of the fifth voltage and the third voltage in the sustain period, and wherein the third voltage is a ground voltage.

22. The plasma display panel of claim 21, wherein the selection circuits each comprise:

a first transistor coupled between a first power source for supplying the first voltage and the third electrode; and a second transistor coupled between a second power source for supplying the second voltage and the third electrode, wherein the plasma display panel further comprises a first switch coupled between the second transistor and the second power source, and turned off when the third electrode is floated.

23. The plasma display panel of claim 22, further comprising a second switch coupled between the first transistor and the first power source, wherein the driving circuit floats the third electrode in the sustain period, and the second switch is turned off while the fourth voltage is applied to the first electrode in the sustain period.

24. The plasma display panel of claim 21, wherein the second electrode is biased with the third voltage in the reset period and the address period.

* * * * *